US005387257A

United States Patent [19]

Tari et al.

[11] Patent Number: 5,387,257

[45] Date of Patent: Feb. 7, 1995

[54] SELF-DESTRUCT FUZE FOR IMPROVED CONVENTIONAL MUNITIONS

[75] Inventors: Michael Tari, Sparta; Louis J. Adimari, Montague; Frank Diorio, Hopatcong, all of N.J.

[73] Assignee: The United States of America as represented by the Secretary of the Army, Washington, D.C.

[21] Appl. No.: 177,493

[22] Filed: Jan. 5, 1994

[51] Int. Cl.[6] ..... E42C 11/06; E42C 14/06

[52] U.S. Cl. ..... 102/226; 102/266

[58] Field of Search ..... 102/223, 225, 226, 227, 102/228, 229, 230, 266, 276

[56] References Cited

U.S. PATENT DOCUMENTS

| | | | |
|---|---|---|---|
| H.251 | 4/1987 | Field | 102/487 |
| 3,862,602 | 1/1975 | Manning | 102/266 |
| 3,998,164 | 12/1976 | Hadfield | 102/226 |
| 4,653,401 | 3/1987 | Gatti | 102/226 |
| 4,762,066 | 8/1988 | Rudenauer et al. | 102/226 |
| 4,811,664 | 3/1989 | Levy et al. | 102/227 |
| 4,998,476 | 3/1991 | Rüdenauer et al. | 102/226 |

*Primary Examiner*—David Brown

*Attorney, Agent, or Firm*—Anthony T. Lane; Edward Goldberg; Michael C. Sachs

[57] ABSTRACT

The invention relates to a fuze for a submunition grenade which will self-destruct electrically in the event that the mechanical primary inertial functioning mode fails to operate upon striking an intended target.

5 Claims, 5 Drawing Sheets

SELF-DESTRUCT FUZE FOR IMPROVED CONVENTIONAL MUNITIONS

GOVERNMENT INTEREST

The invention disclosed herein may be manufactured, used and licensed by or for the United States Government.

BACKGROUND OF THE INVENTION

The use of improved conventional munitions (ICMs) which can deliver a very large number of submunitions by means of an artillery or rocket carrier on a target area has increased the problem of hazardous duds that remain on the battlefield. The danger to follow-up friendly personnel has increased in recent time because of the large quantities of ICM carriers that have been deployed in each mission. Because of the large quantity of submunitions now deployed during each mission, all prior inputs have proven to still leave a prohibitive number of hazardous duds on the battlefield.

SUMMARY OF THE INVENTION

The present invention relates to a submunition which has a secondary self-destruct electrical mode of operation which will function in the event a mechanical or primary fuze mode fails to function.

The first objective of the present invention is to reduce the number of hazardous duds to an acceptable level thereby improving battlefield safety conditions for friendly troops passing through a former targeted area.

Another objective of the present invention is to remove a source of booby trap application by an enemy.

A further objective of the present invention is to improve the life/cost saving in explosive ordnance disposal procedures.

For a better understanding of the present invention together with other and further objectives thereof, reference is made to the following description in connection with the accompanying drawings.

BRIEF DESCRIPTION OF THE DRAWINGS

Throughout the following description like numerals are used to designate like parts of the drawings.

DESCRIPTION OF THE PREFERRED EMBODIMENT

Figure 1:
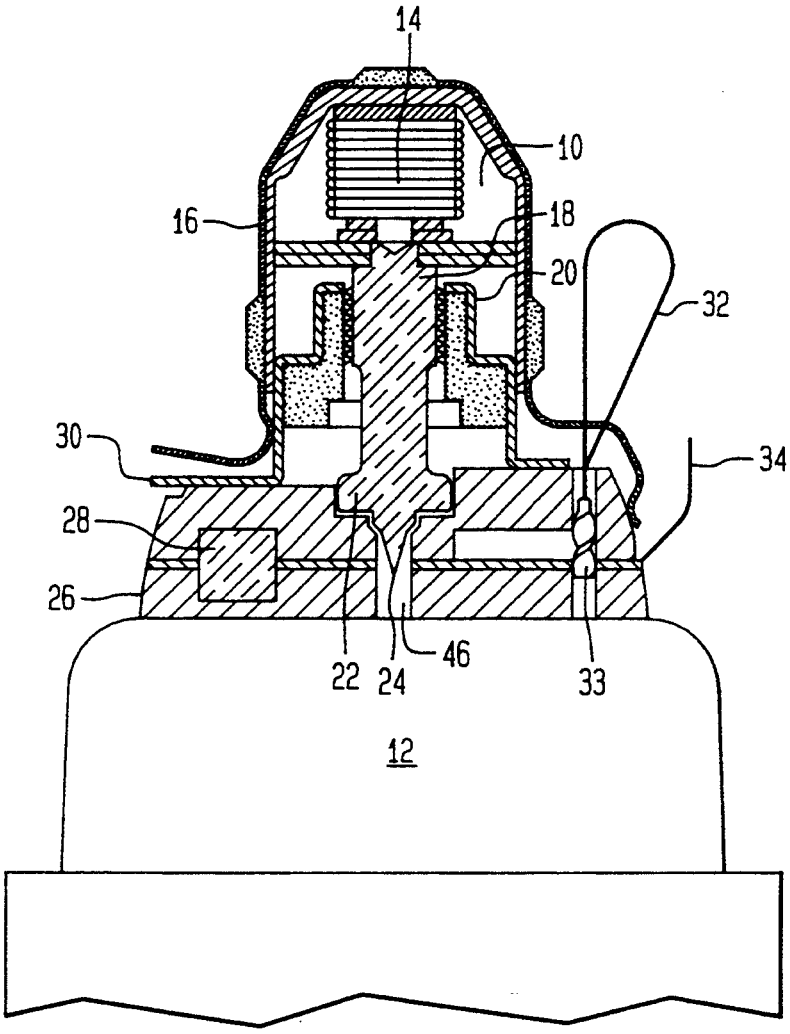
FIG. 1 is a diametral cross-sectional view of a munition with an improved self-destruct fuze.

Referring now to FIG. 1, the self-destruct fuze 10 which is mounted on top of the submunition 12 is designed to self-destruct electrically if the mechanical mode, which functions as a result of inertial impact malfunctions. The mechanical or primary functioning mode has a ribbon stabilizer 14 covered by a packable slide lock cover 16. The ribbon stabilizer 14 or drag device is mechanically connected to an arming screw 18 which is threadedly supported by threaded inertial weight 20. The bottom end 22 of arming screw 18 includes a firing pin 24. The arming screw bottom end 22 engages a spring loaded slide assembly 26 which contains an M55 stab detonator 28 and the components for the electrical self-destruct mode, to be described hereinafter. The components of the electrical and the mechanical modes are contained within the same fuze housing member 30. An aerodynamic spiral safety member 32 acts as an unlocking safety for the electrical self-destruct mode. An aerodynamic unlocking electrical safety member 34 acts as an electro-explosive shunt.

Figure 5:
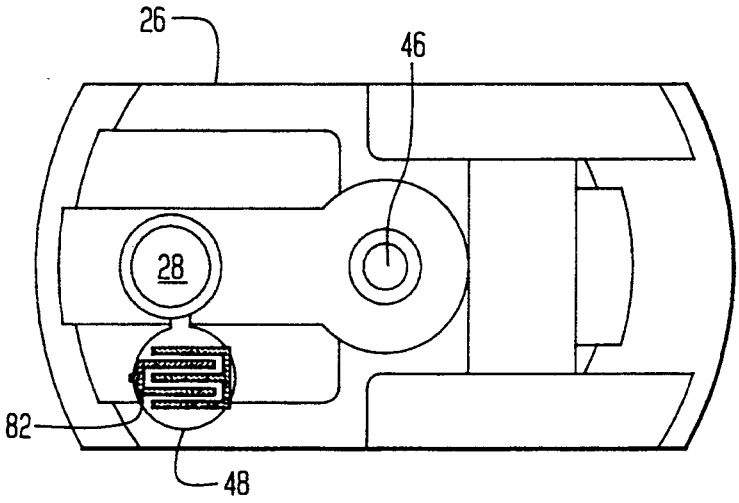
FIG. 5 is a top view of a slide with an electro-explosive device with an electrical "finger" initiator for a conductive explosive mix.

Referring to FIGS. 1, 7, 8 and 9 the slide mentor 26 shows the condition when a reserve lithium battery 36 of FIG. 5 is not activated. Spiral safety 32 is removeably positioned in slide ball member 38 which prevents spring 40 from rotating lever 42 about pivot 44. Under these conditions firing pin 24 is located within slide firing pin hole 46. A safety pin 43 prevents lever 42 from rotating until it is manually removed.

Figure 10:
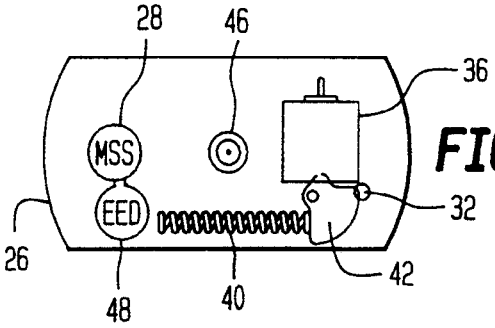
FIG. 10 is a top view of the slide of the self-destruct fuze showing the position of the spiral safety member when the battery is activated.
Figure 11:
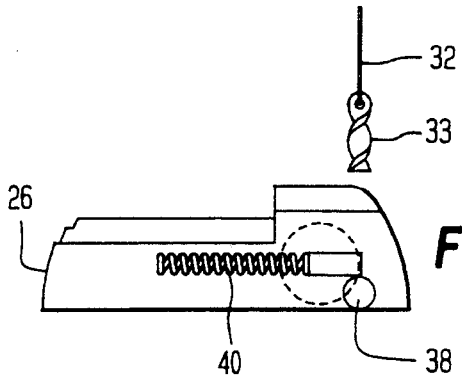
FIG. 11 is a front view of FIG. 10.
Figure 12:
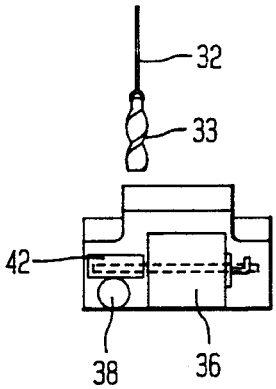
FIG. 12 is an end view of FIG. 11.
Figure 7:
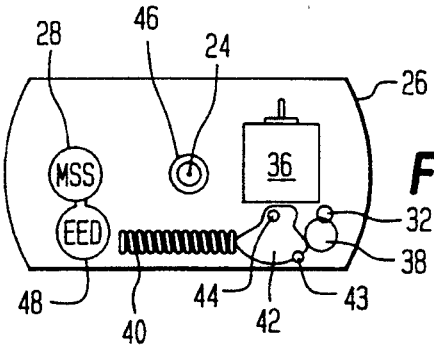
FIG. 7 is a top view of the slide of the self-destruct fuze showing the position of a spiral safety component when the battery is not activated.
Figure 8:
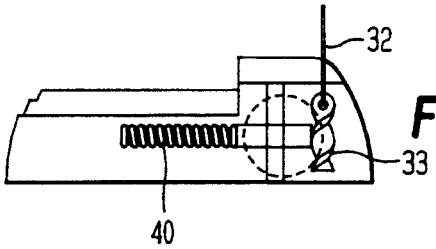
FIG. 8 is a front view of FIG. 7.
Figure 9:
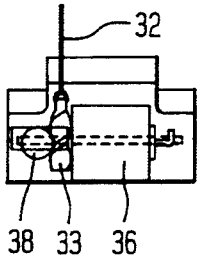
FIG. 9 is an end view of FIG. 8.

Referring now to FIGS. 10, 11 and 12 shows the condition when the reserve lithium battery 36 has been activated by the removal of aerodynamic safety 32 and the denting of the battery by spring loaded lever 42. The electrical activation of the electro-explosive device 48 and the stab detonator 28 is described hereinafter.

Referring to the reserve lithium battery, shown in FIGS. 3, 4, 7, 9, 10 and 12, includes a metal cup-shaped housing 50, a circular cover plate 52 having an anode lead 54 protruding therethrough and insulated therefrom by insulators 56, 56', 56''. A cylindrical-shaped cathode 58 made of carbon black/teflon is disposed intermediate the cell can wall 50 and insulators 56' and 56''. A cylindrical-shaped anode 60 is disposed between insulated separators 56' and 56'' and a glass arepule 62 containing a thionyl chloride electrolyte 64. Flexible lead 63 provides electrical condition between anode cylinder 60 and anode lead 54.

Figure 3:
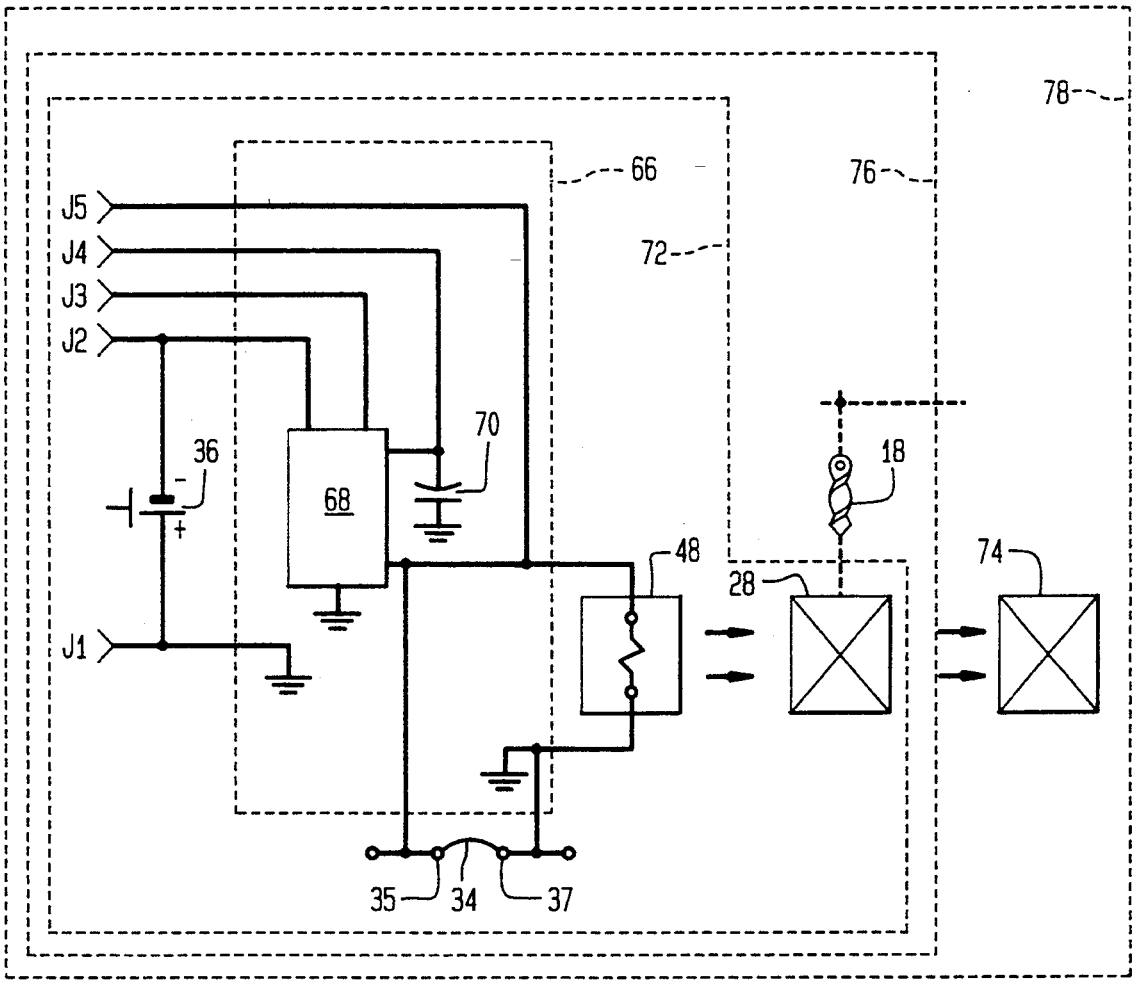
FIG. 3 is an electrical schematic of the self-destruct fuze.
Figure 4:
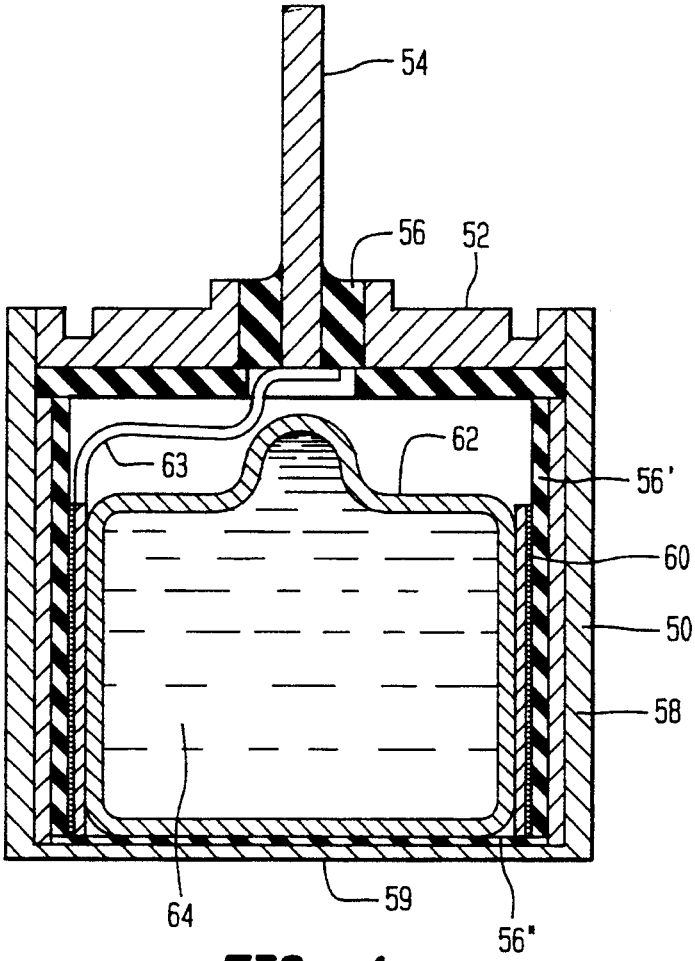
FIG. 4 is a diametral cross-sectional view of a reserve lithium battery used in the improved self-destruct fuze.

Referring now to FIG. 3 schematic, the slide electrical subassembly is included within dotted line 66 and comprises an integrated chip 24-stage counter and voltage quadrupler 68 whose input is connected to battery 36 and whose output discharges a firing capacitor 70 through the electro-explosive device 48 when the electro-explosive safety shunt 34 is aerodynamically removed. The dotted line 72 for the slide assembly includes the aforementioned slide subassembly circuit and the M55 stab detonator 28 and the electro-explosive device 48. Dotted line 76 includes the arming screw 18 of the self-destruct fuze. The fuze self-destruct stab detonator 28 in turn initiates the lead charge 74 of the grenade submunition and is shown within dotted line 78. Jacks J1–J5 are measuring test points for V+, V−, Oscillator output, V capacitor and V detonator respectively. These jacks provide access means to measure circuit input and output voltages.

Figure 6:
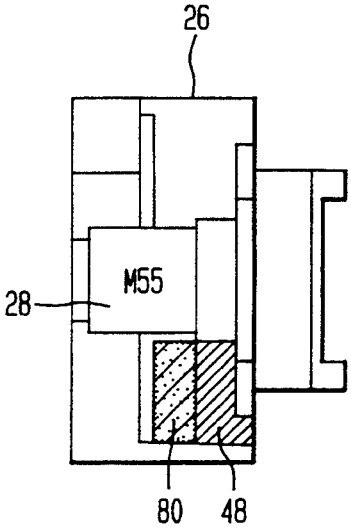
FIG. 6 is a side view of FIG. 5.

Referring to FIGS. 5 and 6 slide 26 holds the electro-explosive device (EED) 48 adjacent to M55 stab detonator 28. The EED 48 includes a conductive explosive mix (CEM) 80 which is designed to conduct electricity. Graphite particles in the CEM 80 form a path and act as an electrical bridge between the fingers 82 of the printed circuit board. The heat generated by the conduction of electricity supplies the energy to function the electro-explosive device (EED) 48. The CEM 80 includes barium nitrate as an oxidizer, calcium silicide as a fuel, graphite as a conductor, and lead styphnate as the energetic material needed to function the output element, mercuric 5-Nitrotetrozole ($HgC_2N_{10}O_4$) (*DXW-1*) of the EED 48.

Referring now to FIGS. 13–21 the ribbon spiral member 32 of FIG. 1 may use an alternate aerodynamic safety pin called a latch. The latch assembly 31 of FIG. 16 does not use a ribbon to employ the air stream but a lower cover 23 made of polycarbonate material. The slide 26 of FIG. 1 and FIGS. 13–15 has an upper cover 25. The latch assembly of FIG. 16 is composed of the lower cover 23 and a lever release pin 27. The lower cover 23 can pivot about point "A" of FIG. 16 when the lower cover 23 is mated to the upper cover 25. Point A is shown in FIGS. 13, 15, 16 and 17. With the latch design, when the fuze is deployed into the wind stream the lower cover 23' is forced upward, as shown in FIG. 17, causing the lever release pin 27 shown in FIGS. 16 and 21, to be removed allowing a locking arm 29, shown in FIG. 21, to be forced aside by the spring loaded lever 42, which as stated previously activates the reserve battery 36.

In operation, the primary mechanical mode requires the ribbon stabilizer drag device 14 to be activated by a wind stream which removes the packable slide lock safety device 16. The drag device 14 unwinds the arming screw 18 from the threaded inertial weight 20 and withdraws the firing pin 24 from the hole 46 of the slide 26 which is moved out by centrifugal force and spring force, not shown, thereby placing the M55 stab detonator 28 in line with the mechanically armed firing pin 24. Upon ground impact of submunition 12, the inertial weight 20 drives the firing pin 24 into the stab detonator 28.

The electrical self-destruct, or secondary functioning mode serves as a back-up to the aforementioned mechanical mode of operation. The electrical self-destruct mode functions the stab detonator 28 should the primary mode fail to do so. The electrical self-destruct mode operation begins at cargo ejection, that is aerodynamic electrical arming, and ends after a three minute delay period, resulting in EED 48 and stab detonator 28 detonation when the submunition 12 is tactically deployed.

The self-destruct slide 26 internally contains a 3 VDC reserve battery 36 shown in FIGS. 3, 4, 7, 9, 10 and 12, a firing capacitor 70, an EED 48, and electrical arming hardware. Electrical arming is defined as battery activation, that is removal of aerodynamic unlocking safety device 32 and the EED aerodynamic unlocking electrical safety shunt 34. Upon electrical mining the battery 36 provides power to the integrated circuit (IC) chip 68. The IC 68 generates a time delay, charges the firing capacitor 70 and discharges the capacitor 70 into the EED 48 at the end of the time delay.

The battery 36 is a reserve type where the electrolyte 64 is contained in glass ampule 62. The ampule 62 is contained within metal case 50. The battery 36 is activated when the glass ampule 62 is broken by dimpling the bottom end 59 of the battery case 50. The battery 36 is dimpled by spring loaded lever 42. The fuze contains a safety device to preclude accidental activation. The safety device comprises a ball 38 and a spiral 33. The ball 38 prevents the spring loaded lever 42 free moving into battery 36. The spiral 33 prevents the ball 38 from moving. The spiral 33 is attached to a loop of ribbon 32 which provides an aerodynamic removal feature. Aerodynamic forces turn the spiral 33 resulting in its removal from ball 38 similar to a screw being removed from a threaded hole. The EED short circuit shunt safety 34 comprises a piece of copper ribbon which is soldered to contact points 35 and 37 shown in FIG. 3. Shunt safety ribbon 34 shorts out the EED 48 when the submunition is not deployed. When the grenade 12 is deployed over the target aerodynamic forces bend the ribbon back and forth until the ribbon shunt 34 breaks away. The short 34 prevents accidental premature detonation. Fuze electrical secondary operation begins at cargo ejection. Aerodynamic forces remove both the spiral safety 33 and the EED shorting ribbon 34. The battery activation spring 40 forces the lever 42 to move the ball 38 down and moves the lever 42 into the battery 36, as shown in FIG. 10, resulting in battery 36 activation. The battery 36 provides power to the IC 68. The integrated circuit (IC) chips' 24–stage counter starts counting internal clock pulses, at a 46.6 KHz rate, beginning with zero. The IC's voltage quadrupler charges the firing capacitor 70 to 13 VDC minimum. When the 24th counter stage toggles at a count of 8,388,608 ($3\pm1$ minute) the IC's fire circuit discharges the firing capacitor 70 into the EED 48 which in turn initiates stab detonator 28 and in turn initiates grenade lead charge 78.

Figure 2:
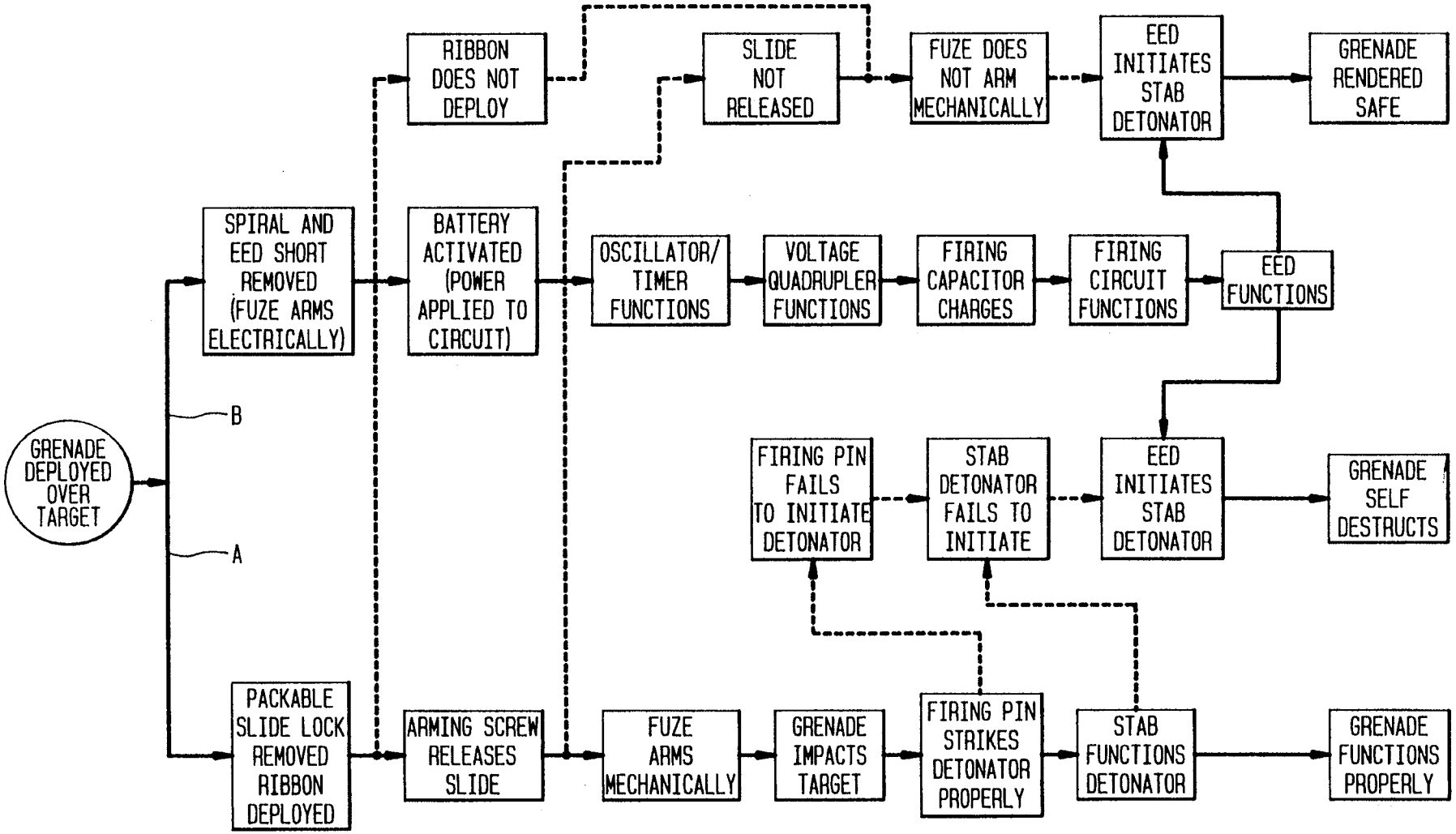
FIG. 2 is a flow diagram of the functions of the improved self-destruct fuze after the submunition has been deployed over the target.

FIG. 2 flow diagram shows the primary mechanical grenade functioning mode by following the arrows in branch A. The secondary electrical self-destruct mode is detailed by following the arrow lines along branch B. The dashed lines of FIG. 2 indicate failure modes which lead to EED function blocks which take care of these failure modes leading to self-destruct of the grenade 12 or rendering the grenade 12 safe.

While a specific embodiment of the invention has been shown and described in detail to illustrate the application of the principles of the invention, it will be understood that the invention may be embodied otherwise without departing from such principles.

What is claimed is:

1. A self-destruct fuze which comprises:

means for mechanically exploding a submunition grenade upon inertial impact which includes:

a fuze housing member operatively connected to said submunition;

a ribbon stabilizer disposed in said housing;

a packable slide lock aerodynamically removable from said housing;

an arming screw attached to said ribbon stabilizer having a firing pin located on a bottom end of said arming screw;

an inertia weight threadedly attached to said arming screw;

a spring loaded slide assembly operatively supporting said arming screw;

a stab detonator positioned in said slide assembly and in alignment with said firing pin when said fuze has been aerodynamically armed;

means for electrically self-destructing said submunition when said mechanical means fails to explode said submunition after a fixed time period;

wherein said means for electrically self-destructing said submunition includes:

means for aerodynamically electrical arming said grenade at submunition ejection; and electro-explosive means for initiating said slab detonator when said means for mechanically exploding fails to do so after a fixed interval of time; and wherein said means for aerodynamically electrical arming includes:

a spiral safety member aerodynamically removed from said slide member at cargo ejection;

an electrical shunt member aerodynamically removed from said slide member at cargo ejection;

a reserve battery operatively disposed in said slide assembly; and a spring loaded lever actuator operatively placed adjacent to said reserve battery for initiating said reserve battery when said spiral safety member is aerodynamically removed.

2. A self-destruct fuze as recited in claim 1 wherein said reserve battery includes:

a metal battery housing;.

a cylindrical oathode adjacent to and in electrical contact with said housing made of carbon black/teflon material;

a cylindrical separator operatively disposed within said cathode cylinder;

a cylindrical anode made of nickel/lithium material operatively disposed within said separator and mechanically isolated from said cathode by said separator; and a sealed glass ampule containing thionyl chloride electrolyte therein, said ampule operatively positioned in said battery housing to break and release said electrolyte when said spring loaded lever actuator is aerodynamically released by said spiral safety member.

3. A self-destruct fuze as recited in claim 2 wherein said electro-explosive device (EED) includes an electrical circuit which includes:

an integrated circuit means electrically coupled to said reserve battery, said integrated circuit having an oscillator and voltage quadrupler therein for providing a firing output signal after a fixed time interval; and a firing capacitor charged by said reserve battery and electrically coupled to the output of said integrated circuit for initiating said electro-explosive device (EED).

4. A self-destruct fuze as recited in claim 3 wherein said electro-explosive device further includes a conductive explosive mix which has graphite particles forming a path therein which conduct electricity therethrough and acts as an electrical bridge between fingers on the printed wiring board (PWB) generating heat and the necessary energy to function the electro-explosive device.

5. A self-destruct fuze as recited in claim 4 wherein the conductive explosive mix includes:

a barium nitrate oxidizer;

a calicum silicide fuel a conducting material such as graphite; and an energetic material such as lead styphnate.

* * * * *

UNITED STATES PATENT AND TRADEMARK OFFICE

CERTIFICATE OF CORRECTION

PATENT NO. : 5,387,257

DATED : February 7, 1995

INVENTOR(S) : Michael Tari; Louis J. Adimari; and Frank Diorio

It is certified that error appears in the above-identified patent and that said Letters Patent is hereby corrected as shown below:

In Column 5, line 8, "slab" has been changed to ---stab---.

In Column 5, line 29, "oathode" has been changed to -- cathode --.

Signed and Sealed this

Twenty-fourth Day of September, 1996

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,387,257

DATED : February 7, 1995

INVENTOR(S) : Michael Tari; Louis J. Adimari; and Frank Diorio

It is certified that error appears in the above-identified patent and that said Letters Patent is hereby corrected as shown below:

In column 2, line 24, "mentor" has been changed to -- member --. In line 47, "arepule" has been changed to --ampule--. In line 49, "condition" has been changed to --connection--.

In column 3, lines 15-32 have been deleted.

In column 4, line 6, "free" has been changed to --from--. In line 62, "inertia" has been changed to --inertial--.

In column 5, line 8, "slab" has been changed to --stab--. In line 28, "oathode" has been changed to --cathode--.

In column 6, line 37, "calicum" has been changed to --calcium--.

Signed and Sealed this

Tenth Day of November 1998

Bruce Lehman

*Attest:*

BRUCE LEHMAN

*Attesting Officer*

*Commissioner of Patents and Trademarks*